US005178565A

United States Patent [19]

Jacobson

[11] Patent Number: 5,178,565

[45] Date of Patent: Jan. 12, 1993

[54] LOWER UNIT GUARD

[76] Inventor: Kenneth A. Jacobson, 16140 Lynch Ave., Lakeville, Minn. 55044

[21] Appl. No.: 682,132

[22] Filed: Apr. 8, 1991

[51] Int. Cl.[5] ..... B63H 5/16

[52] U.S. Cl. ..... 440/71; 416/247 A

[58] Field of Search ..... 440/71, 72; 416/247 A

[56] References Cited

U.S. PATENT DOCUMENTS

| | | | |
|---|---|---|---|
| 2,717,570 | 9/1955 | Willoughby | 440/71 |
| 3,027,864 | 4/1962 | Polson | 416/247 A |
| 4,565,533 | 1/1986 | Springer | 440/71 |
| 4,718,871 | 1/1988 | Mendelevitch | 440/71 |
| 5,007,869 | 4/1991 | Zoellner | 440/71 |

FOREIGN PATENT DOCUMENTS

| | | | |
|---|---|---|---|
| 116296 | 7/1983 | Japan | 440/71 |

*Primary Examiner*—Sherman Basinger

*Attorney, Agent, or Firm*—Palmatier & Sjoquist

[57] ABSTRACT

A guard attachable to the lower unit of an outboard motor preventing direct impact between submerged hazards and the elements of the lower unit. The guard includes two angle brackets, a rigid bar attached to the angle brackets at a top end, and a skeg pocket and fin attached to a lower portion of the bar. The guard descends from a position forward of, and substantially level with, the cavitation plate to a point below the skeg. The guard prevents damage to the entire lower unit, including the propeller, upon impact with a submerged obstacle.

11 Claims, 2 Drawing Sheets

LOWER UNIT GUARD

BACKGROUND OF THE INVENTION

This invention relates to safety devices for outboard motors; more particularly, the invention relates to a safety guard for protecting the lower portion of an outboard motor which is submerged while in use.

Boat owners propel boats with conventional outboard motors. During use, the lower unit of an outboard motor occasionally strikes submerged objects such as rocks, stumps, logs, or other hazards. Damage to the propeller, drive shaft, drive shaft housing, gears, gear casing, and skeg occur upon impact between the lower unit and a submerged obstacle. Damage to an element of the lower outboard motor unit may necessitate stoppage of a motor for repairs and prevent additional use and enjoyment of the motor.

Patents concerning guards designed specifically to protect the propeller, or only a portion of the lower unit, include the Wise U.S. Pat. No. 2,140,099, Sydney U.S. Pat. No. 2,470,874, Brown U.S. Pat. No. 2,894,477, Fester U.S. Pat. No. 2,963,000, Martinson U.S. Pat. No. 3,025,825, Karls U.S. Pat. No. 4,925,412, Arado U.S. Pat. No. 2,355,842, Faunda U.S. Pat. No. 4,902,255, Newman U.S. Pat. No. 4,826,461 and Springer U.S. Pat. No. 4,565,533. The prior art deflects obstacles away from the propeller and incidentally assists in the elevation of the lower unit as it passes over a submerged object. These guards do not sufficiently safeguard all the elements of a lower unit from damage resulting from impact with submerged hazards.

In the past guards have generally been secured to an outboard motor forward of the propeller. These guards are designed to protect and reduce the risk of damage only to a predetermined portion of the lower unit, specifically the propeller. The remainder of a lower unit of a conventional outboard motor remains unprotected by prior art.

SUMMARY OF THE INVENTION

The present invention is a guard for the protection of the entire lower unit of a conventional outboard motor. The invention is sturdy, simple, and effective in protecting a conventional outboard motor.

The invention is a guard which is located forward of the lower unit of an outboard motor and generally descends from a position forward of and substantially level with the cavitation plate, to a point below the rear portion of the skeg. The guard assists the lower unit to slide over the top of a submerged object, thereby protecting the lower unit and the propeller from damage. In the present invention the extension of the guard below the skeg prevents the propeller from striking an object as the lower unit completes its passage over the object and descends back to a normal position. The prior art does not adequately protect the propeller from such damage which could occur as the lower unit and propeller descend back to a normal position after passing over the top of the object. The present invention increases the useful life of a conventional outboard motor, significantly reducing the potential damage to any portion of the lower unit as a result of impact with a submerged object. The guard includes two angle brackets, a rigid bar containing a semicircular apex, a pocket, and a fin. The guard prevents damage to the entire lower unit, including the propeller, upon impact with a submerged obstacle.

An object of the present invention is to provide resilient, durable protection to the entire lower unit of a conventional outboard motor, preventing the lower unit from being bent, damaged, or rendered inoperable as a result of impact with a submerged hazard.

Another object of the invention is to minimize resistance or drag to the lower unit, and eliminate interference in the steering operations of the motor.

Still another object of the invention is to provide a simple, economical, easily securable, and safe guard for use with conventional outboard motors.

A feature of the invention is the adaptability of the guard to conform to conventional outboard motors.

Another feature of the present invention is a rigid bar mounted forward of the entire lower unit, depending below the skeg, protecting the entire lower unit from damage resulting from impact with submerged objects.

Still another feature of the invention are pivotally mounted angle brackets providing easy, efficient, and sturdy attachment of the guard to the cavitation plate of an outboard motor.

Still another feature of the invention is the pocket for encasing and protecting the skeg from damage caused by impact with submerged hazards.

Still another feature of the invention is the fin located below the skeg, preventing excessively rapid elevation and descent of the lower unit, toward or away from the water surface, as a result of impact with a submerged object.

DETAILED DESCRIPTION OF THE PREFERRED EMBODIMENT

Figure 1:
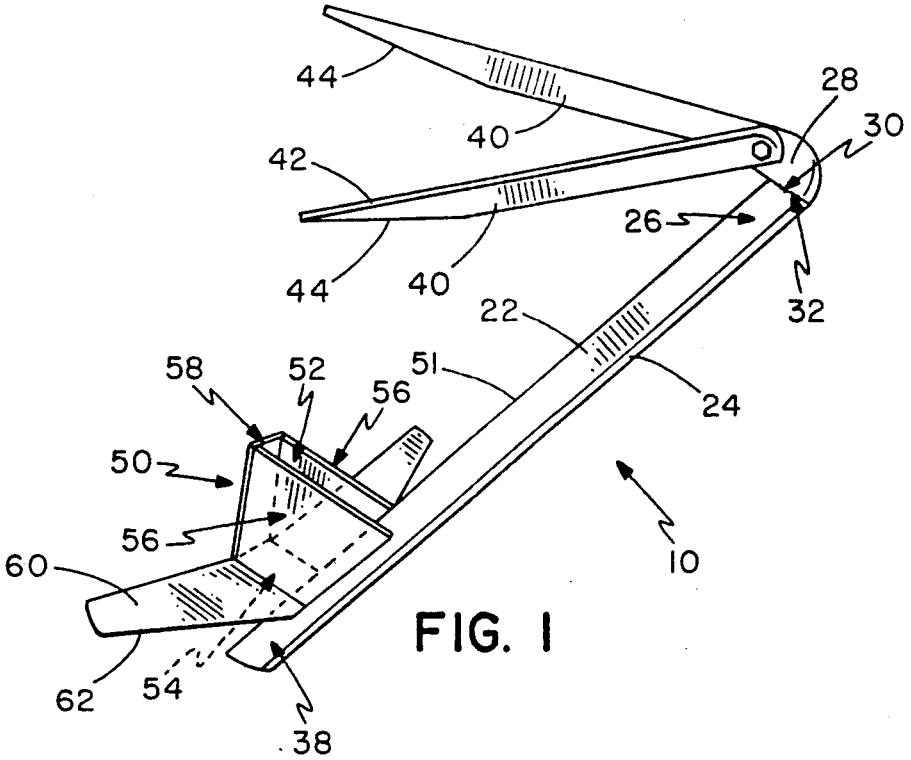
FIG. 1 is an isometric view of the lower outboard motor unit guard.

One form of the invention is illustrated and described herein. The improved lower unit guard is indicated in general by the numeral 10. The lower unit guard 10 is suitably attached to a conventional outboard motor having a longitudinally, horizontally extending cavitation plate 14, a vertically depending drive-shaft housing 15, a lower gear case housing 16, a propeller 18 located at the rear of the gear case housing 16, and a depending skeg 20. (FIG. 2) The conventional outboard motor and the above referenced elements are well known in the art.

Figure 2:
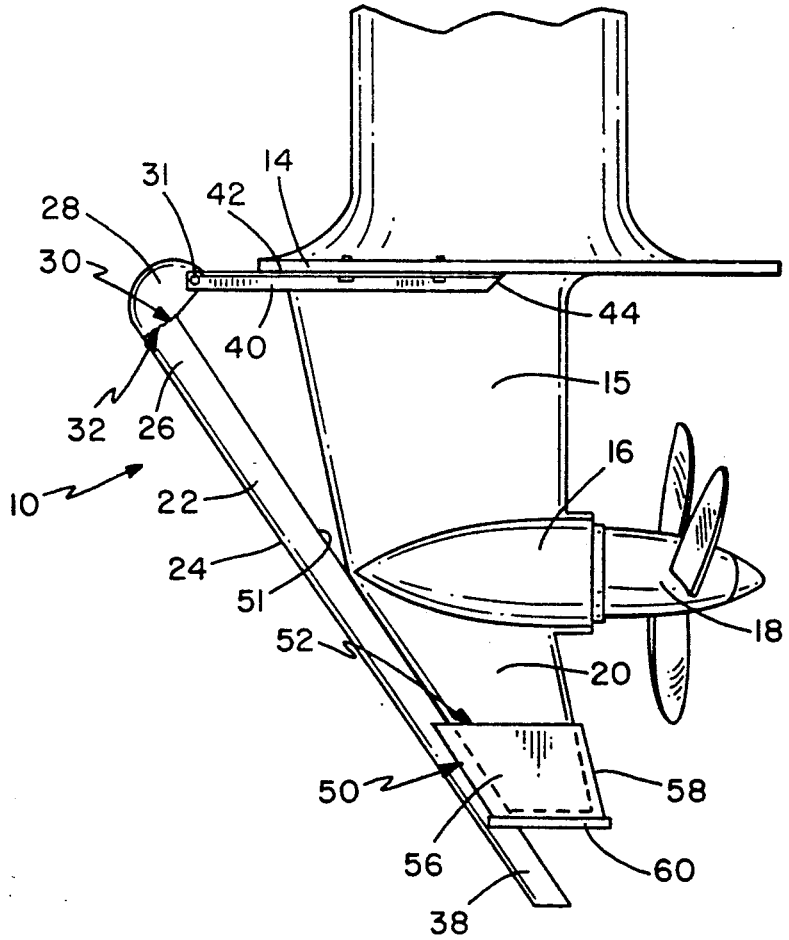
FIG. 2 is a side elevation view of the lower outboard motor unit guard mounted on an outboard motor.
Figure 4:
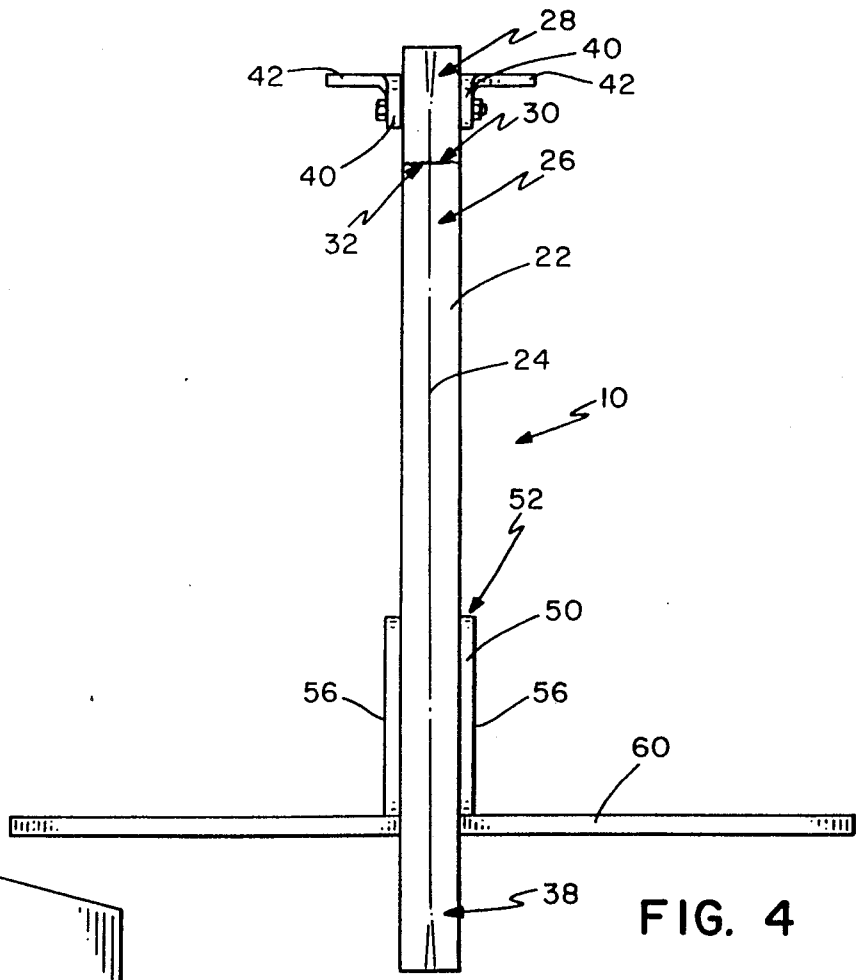
FIG. 4 is a front view of the lower outboard motor unit guard.

All portions of the lower unit guard 10 are preferably fabricated of stainless steel metal. The guard 10 attaches to the cavitation plate 14 and retains the skeg 20 (FIG. 2). The guard 10 does not interfere with pivotal elevation of the lower unit out of the water as known in the prior art. The guard 10 does not inhibit steering of the conventional outboard motor during operation and use.

In the art an outboard motor is generally secured to the transom of a boat by a clamping assembly having a pivot bolt for movement of the outboard motor permitting the lifting of the motor to the rear vertically about a transversely extending and horizontally disposed axis. The present invention, in conjunction with forward movement of the boat, causes any obstacles below the surface of the water to be engaged by the lower unit guard 10. The guard 10 causes the lower unit to slide rearwardly and upwardly over the top of the obstacle. The obstacle then passes beneath the guard 10 thereby protecting the propeller and the lower unit. The beveled leading forward edge 24 of the bar 22 forces movable obstacles to move downwardly and rearwardly, or otherwise forces the lower unit to pivot up, via the pivotal mounting of the motor to a boat, sliding the lower unit up and over the hazard.

The lower unit guard 10 is comprised of a substantially vertically extending rigid rectangular bar 22 with a beveled leading front edge 24 (FIG. 1). The bar 22 suitably attaches forward of the lower unit preventing damage or interference with the propeller 18, and other lower outboard motor parts, upon impact with a submerged obstacle.

The rigid rectangular bar 22 has approximate width dimensions of one inch and a thickness of about one-quarter inch. The height of the bar 22 varies, depending upon the make, horsepower, length, and dimensional size of the lower outboard motor unit to which it is affixed. The height of the bar 22 descends from the approximate level of the cavitation plate 14 to about five inches below the lowest portion of the skeg 20 (FIG. 2).

The rigid bar 22 is mounted immediately forward of the leading edge of the drive-shaft housing 15. The bar 22 contains a top end portion 26 adapted for positioning forward of and substantially level with the horizontally extending cavitation plate 14. A flat two-sided semicircular apex portion 28 is attached to the top end portion 26. The apex 28 is preferably composed of the same stainless steel metal as the rigid bar 22 and is suitably welded- thereto. The apex 28 is suitably adapted for flush contact and welding between the bottom edge 30 of the apex 28 and the top edge 32 of the bar 22. The forward beveled edge of the semicircular apex 28 is flush with the forward beveled edge 24 of the bar 22 and is suitably welded thereto. The apex portion 28 is positioned forward of the leading edge of the drive-shaft housing 15 and is of the same elevation as the cavitation plate 14. The apex portion 28 suitably defines an open space between the guard 10 and the drive-shaft housing 15. The rear portion of the apex 28 is proximal to the leading edge of the drive-shaft housing 15. The beveled forward edge of the bar 22 is therefore continuous, providing an effective means for deflection of submerged objects downward and rearward from the lower outboard motor unit. The bar 22 also functions to assist in the elevation of the lower unit to slide over the top of stationary submerged objects.

As seen in FIG. 2, the bar 22 is attached at its forward, upper extremity 26 by a fastener 31, in front of the cavitation plate 14, and depends vertically downward, slanted rearward past the leading edge of the gear case housing 16. The bar 22 continues downward and rearward, fitting in flush contact with, and parallel with, the leading edge of the skeg 20. The bar 22 continues depending downward and rearward from the skeg 20 approximately 5 inches.

The angle of the bar 22 to the drive-shaft housing 15 assists in the elevation of the lower unit upon impact with a submerged object. The bottom end portion 38 of the bar 22 will continue to cause the lower unit to remain elevated as the lower unit passes over the top of an obstacle. The bottom end portion 38 prevents a rapid descent delaying the return of the lower unit to a normal position until such time as the lower unit has completely traversed the submerged obstacle. The bottom end portion 38 also forces a movable obstacle downwardly and rearwardly, preventing collision of the obstacle with the propeller.

Figure 3:
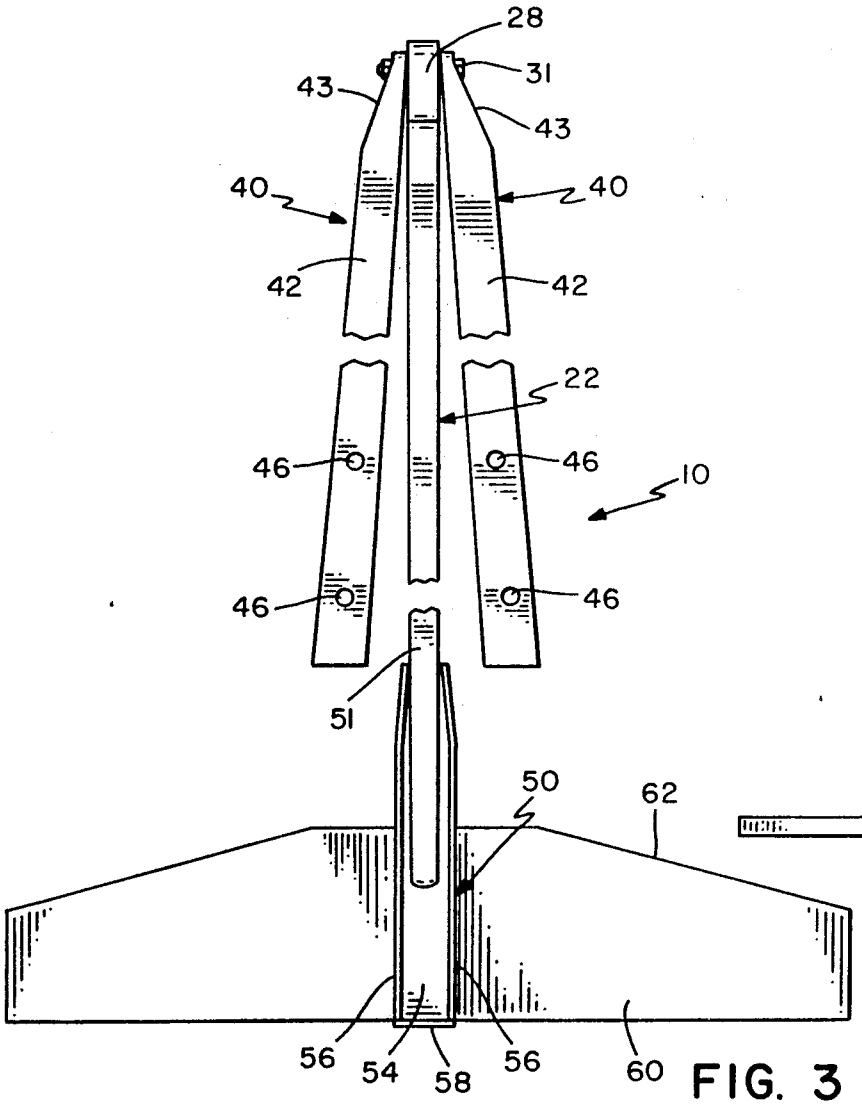
FIG. 3 is a top view of the lower outboard motor unit guard.

As seen in FIGS. 1, 2, and 3 the guard 10 is mounted to the lower unit of the outboard motor by a pair of rearwardly, horizontally-extending angle brackets 40 attached to the motor's cavitation plate 14. The angle brackets 40 lie in a plane directly below and suitably parallel with the cavitation plate 14. The pair of angle brackets 40 extend rearwardly and horizontally from fastener 31 on opposite sides of the apex 28, in diverging relation to each other. The angle brackets 40 straddle the drive-shaft housing 15, and each is attached to an opposite side of the cavitation plate 14. Attachment of the angle brackets 40 to opposite sides of the cavitation plate 14 increases the stability and eliminates movement of the guard 10 in relation to the lower unit. The pair of angle brackets 40 are suitably pivotally attached to opposite sides of the rear portion of the apex 28 by fastener 31. The angle brackets 40 are preferably of rigid stainless steel construction. The angle brackets 40 are of sufficient strength to not fracture or bend upon the impact of the lower unit guard 10 with a submerged obstacle. Horizontally extending flanges 42 are located along the top portion of the pair of angle brackets 40, and flanges 42 contain openings 46 for vertical alignment with openings 48 located through the cavitation plate 14. The angle brackets 40 are secured to the cavitation The flange portions 42 contain a tapered forward edge 43 leading to the rearward portion of the apex 28.

The guard 10 is attached to the lower unit of the outboard motor by inserting the skeg 20 into the guard's skeg pocket 50 (FIG. 2). The skeg pocket 50 is attached to the bar 22 approximately 5 inches above and forward its lower extremity. The front edge of the skeg pocket is shaped to fit and be welded to the bar 22. The skeg pocket 50 is generally shaped in a truncated rectangular box form where the rearward edge 51 of the depending bar 22 defines the leading edge of the pocket 50. The skeg pocket is box shaped to enclose the skeg 20. The pocket 50 has a horizontally-extending rectangular open top 52 and a closed base 54. The pocket 50 contains a pair of substantially truncated rectangular sidewalls 56 and a rectangular rear wall 58. The pocket 50 extends vertically for the required distance along the bar 22. The rectangular sidewall portions 56 traverse the rearward edge 51 of the bar 22 the required distance, sufficient to seat the skeg 20. A fin 60 extends laterally, horizontally, and rearwardly from the bar 22 and is affixed to the bottom of the side and rear walls 56, 58 by welding, thereby defining the closed base 54 of the pocket 50. The skeg 20 fits flush against, and rests squarely upon, the base 54 when inserted into the. pocket 50. Skeg 20 is snugly confined by the side and rear walls 56, 58. After the insertion of the skeg 20 into the pocket 50, the flange portions 42 of the angle brackets 40 may be secured to cavitation plate 14. The position of the rear edge 51 of the guard 10 will be flush, parallel to, and remain in substantial contact with, the leading edge of the skeg 20.

The skeg pocket 50 is shaped and positioned to avoid all interference or contact with the propeller. The attachment of the guard 10 to the lower unit eliminates movement of the guard laterally, vertically, or horizontally.

The fin 60 is formed of a horizontal plate of about one-eighth inch thick stainless steel metal which is generally rectangular in shape with a tapered leading edge 62. The fin 60 extends horizontally, rearwardly, and laterally, lying in a plane directly below the pocket 50. The fin 60 provides lateral protection to the propeller, preventing contact between the propeller and a submerged object. Without the fin, the motor and lower unit may pivot sharply into a submerged hazard. In such a case the fin 60 will prevent lateral contact between the propeller and the object.

The fin 60 assists a boat in acquiring a planar configuration to the water surface while traveling in a forward direction.

The fin 60 assists in preventing rapid elevation and descent of the lower unit as a result of impact with a submerged object, and extends beyond the rear edge of the propeller to protect the motor from low-speed reverse movement.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. An improved guard for the lower unit of an outboard motor having a horizontally-extending cavitation plate and vertically-extending drive-shaft housing, having attachment only to the cavitation plate, comprising:

a) an elongate rigid bar having a top end portion and a bottom end portion;

b) a pair of brackets, each having a horizontally-extending flange pivotally attached to the top end portion of said bar with said flanges, extending rearwardly and horizontally therefrom, and means for attachment of said flanges to opposite sides of the horizontally-extending cavitation plate; to pivotally support said top end portion of said bar forwardly of said cavitation plate c) a skeg pocket having an open top attached a predetermined distance from the bottom end portion of said bar, said pocket being sized to receive the outboard motor skeg, said pocket having closure walls about said skeg, whereby said pocket and said bar cooperate to capture and hold said skeg without attachments when said pair of brackets are attached; and d) a fin portion attached to the lower ed of said skeg pocket and said bar, said fin extending horizontally, rearwardly, and laterally, therefrom, providing lateral projection to said propeller, said bar extending downwardly from said fin portion.

2. The apparatus of claim 1, further comprising said rigid bar having a beveled leading forward edge.

3. The apparatus of claim 1, further comprising said bar top portion further having a semicircular apex.

4. The apparatus of claim 1, wherein said means for attachment of said flanges further comprises:

a) a first plurality of holes located through the horizontally-extending flanges;

b) a second plurality of holes located through the horizontally extending cavitation plate; and c) a plurality of stainless steel bolts and nuts adapted for insertion into and attachment through the first and second plurality of holes.

5. An improved guard for the lower unit of a conventional outboard motor which has the normal horizontally-extending cavitation plate, vertically-extending drive shaft housing, gear case housing, propeller, and skeg; the improved lower unit guard having attachment means only to the cavitation plate and comprising:

a) an elongate rigid bar portion having a top end portion adapted for positioning forward of and substantially level with the cavitation plate, the rigid bar portion further adapted to extend downward and rearward, in front of and substantially parallel to the skeg, the rigid bar portion further adapted to continue to extend downward and rearward having a bottom end portion adapted for positioning below the skeg;

b) a two-sided semicircular apex portion adapted for attachment to the top end portion, and having means for pivotal attachment to said outboard motor;

c) a skeg pocket having an open top adapted for rearward attachment toward the lower end of the rigid bar portion, and further comprising side and rear walls to capture and contain the skeg without attachments when the apex portion is attached to the outboard motor; and a fin portion attached a predetermined distance from the lower end of the rigid bar, extending rearward, horizontally, and longitudinally therefrom, and further attached to the skeg pocket; said fin portion providing lateral protection to said propeller.

6. The apparatus of claim 5, further comprising a pair of angle bracket portions having horizontally-extending flanges, adapted for pivotal attachment to opposite sides of the semicircular apex portion, extending rearwardly and horizontally therefrom, further adapted for straddling the drive-shaft housing and for attachment to opposite sides of the horizontally-extending cavitation plate.

7. The apparatus of claim 6, further comprising said elongate rigid bar portion having a beveled leading forward edge.

8. The apparatus of claim 7, further comprising said semicircular apex portion having a beveled leading forward edge.

9. The apparatus of claim 8, further comprising the lower unit guard composed of stainless steel.

10. The apparatus of claim 9, further comprising attachment means adapted for securing the horizontally-extending flanges to the cavitation plate.

11. The apparatus of claim 10, wherein the attachment means comprises:

a) a first plurality of holes through the horizontally-extending flanges;

b) a second plurality of holes located through the horizontally-extending cavitation plate; and c) a plurality of fasteners adapted for insertion into and attachment through the aligned first or second plurality of holes.

* * * * *